United States Patent [19]

Kim

[11] Patent Number: 4,976,441

[45] Date of Patent: Dec. 11, 1990

[54] SINGLE PIECE MOLDED HOUSING AND SPIDER FOR ELECTRONIC DARTBOARD

[76] Inventor: Samuel Kim, 3820 Charlemagne Dr., Hoffman Estates, Ill. 60195

[21] Appl. No.: 480,608

[22] Filed: Feb. 15, 1990

[51] Int. Cl.[5] ..... F41J 3/02; F41J 5/052

[52] U.S. Cl. ..... 273/376

[58] Field of Search ..... 273/376, 374

[56] References Cited

U.S. PATENT DOCUMENTS

| | | | |
|---|---|---|---|
| 4,586,716 | 5/1986 | Brejcha et al. | 273/376 |
| 4,635,940 | 1/1987 | Kelley | 273/376 |
| 4,836,556 | 6/1989 | DeVale et al. | 273/376 |

*Primary Examiner*—Benjamin Layno

*Attorney, Agent, or Firm*—Laff, Whitesel, Conte & Saret

[57] ABSTRACT

A dart game assembly comprising a housing element, a spider, a plurality of target plates and a back plate. The spider is generally circular in shape and comprises a series of circumferentially and radially extending ribs integrally molded with the housing element from a single piece of material. The circumferentially and radially extending ribs form interiorly spaced cavities that are adapted to receive the plurality of target plates. Each of the plurality of target plates comprises several target segments which are interconnected and capable of independent movement upon being impacted by a dart. The back plate is integrally molded from a single piece of material and is attached to the housing element.

9 Claims, 6 Drawing Sheets

(PART 1)

(PART 2)

SINGLE PIECE MOLDED HOUSING AND SPIDER FOR ELECTRONIC DARTBOARD

FIELD OF THE INVENTION

This invention relates to a dartboard. More particularly, this invention relates to an electronic dartboard having a housing assembly with a spider, back plate unit and target segments, each of which are manufactured as single pieces, along with the various structural components thereof.

BACKGROUND OF THE INVENTION

A variety of dartboard assemblies are known. These assemblies include multi-piece dartboard housings that include features such as automatic score indicators, dart-retentive target plates, different scoring areas and the like. However, it has been discovered that while such housing assemblies are popular for the user there are problems associated with their manufacture, including a time-consuming and complicated process involving the assembly of the numerous individual pieces that structurally comprise the dartboard housing.

One such presently available dartboard housing assembly is shown in Jones U.S. Pat. No. 4,057,251, which illustrates a dartboard having a support plate which is separate from and secures a spider having a circular rim, circumferentially and radially extending ribs, and annular walls and webs that are molded integrally with the ribs. The above-mentioned pieces are assembled to form pie-shaped target segments for the different scoring areas. The spider piece in the Jones patent is thus basically formed from assembling numerous different pieces and positioning them on the support of the housing element. Therefore, the Jones dartboard housing assembly is not molded from a single-piece of material but instead is assembled by integrally connecting a plurality of individual pieces. Such assembly is time consuming and expensive to manufacture.

Accordingly, an object of the present invention is to provide a dartboard housing assembly having a structure which is molded from a single piece of material.

Another object of the present invention is to provide a dartboard housing that is sturdier and easier to manufacture.

Another object of the present invention is to provide a dartboard housing assembly that expedites the assembly of several pie-shaped target plates comprising interconnected yet independently movable target segments.

A further object of the present invention is to provide a dartboard housing that is less expensive to produce and enables manufacturers to reduce costs incurred in the assembly of the board.

SUMMARY OF THE INVENTION

The present invention in the preferred embodiment comprises an assembly that accomplishes the foregoing objects by providing a dartboard housing assembly comprising separate spider, back plate and target segments. Each of these individual segments, in and of themselves, are molded from a single piece of material. The dartboard assembly comprises, in part, a dartboard having an array of interconnected target plates comprising target segments that are capable of independent movement and which fit into a spider that has been integrally molded with a housing element from a single piece of material The housing element also includes mounting parts that are integrally molded into the structure of the housing element. The target segments are also molded from a single piece of material and are interconnected by thin living hinges which enable the segments to move independently while remaining connected for fast insertion into the spider and housing element during assembly of the dartboard. The dartboard assembly further includes a back plate that serves to protect the inner workings of the dartboard and to hold the mylar switch. The back plate is also molded from a single piece of material.

It is precisely this structure—a one-piece housing element and spider, a one-piece target segment and a one-piece back plate—of the inventive dartboard that results in a sturdier and more inexpensive dartboard to manufacture.

The above, as well as other objects and advantages of the invention, will become apparent from the following detailed description of the preferred embodiments, reference being made to the accompanying drawings.

DETAILED DESCRIPTION OF THE INVENTION

Figure 1:
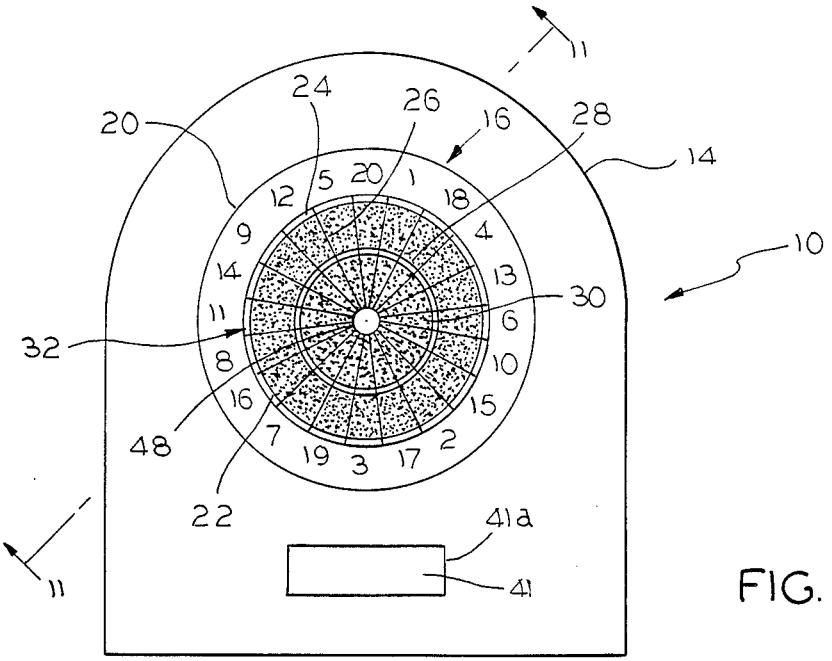
FIG. 1 is a plan view of the exterior of the inventive dart board and housing element.

FIGS. 1–5 and 9–11 illustrate the inventive dartboard assembly 10 which is adapted to receive a dart 12 (FIG. 5) that is thrown at and captured by the board. The dartboard assembly 10 comprises, in part, a single-piece housing element 14 with dartboard portion 16 and a spider 32 which are integrally molded with the housing element 14. Spider 32 of dartboard portion 16 also houses movable target plates 21 which are interconnected, independently moveable, and are manufactured from a single piece of material. A single-piece back plate 34 is attached to housing element 14 and secures mylar switch 68.

Figure 7:
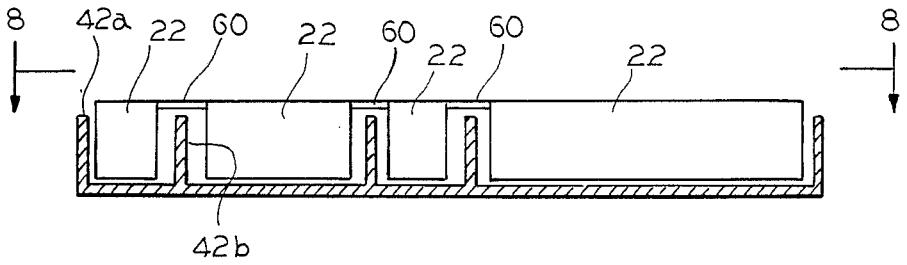
FIG. 7 shows a side view of a target plate as it is assembled in the spider, taken along lines 7—7 of FIG. 3.
Figure 8:
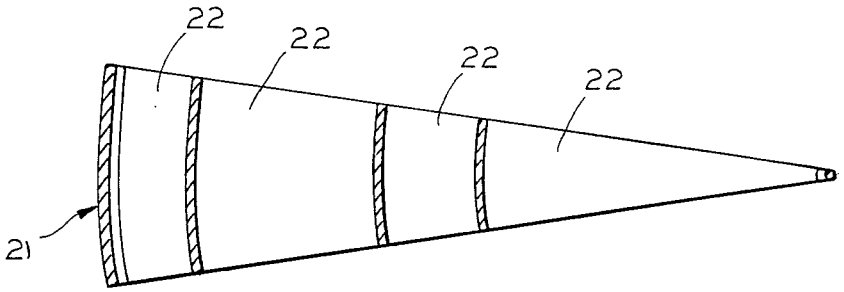
FIG. 8 shows a plan view of the target plate of FIG. 7, taken along lines 8—8 of FIG. 7.

Referring first to FIG. 1, dartboard assembly 10 consists of housing element 14 which is integrally molded as a single structure with dartboard portion 16 and spider 32. Microprocessor board 41 is mounted to housing element 14 and is visible through aperture 41*a*. Dartboard portion 16 is generally uni-planar with the face or front of housing element 14, and includes a circular portion 20 comprising a plurality of different movable target plates 21 all of which are formed from a single piece of material and which further comprise several target segments 22 (see FIGS. 4, 7 and 8) that designate scoring areas with different scoring values and which will be discussed in greater detail later. The target segments 22 extend circumferentially and radially within spaced cavities 24, 26, 28 and 30 and have varying shapes as more clearly shown in FIGS. 2–4. The target segments 22 are separated and retained by spider 32 that is integrally molded with the housing element 14 and which is manufactured from a single piece of material, as previously mentioned. The plates 21 in one embodiment are molded from a single piece of material and are interconnected by living hinges 62.

Figure 2:
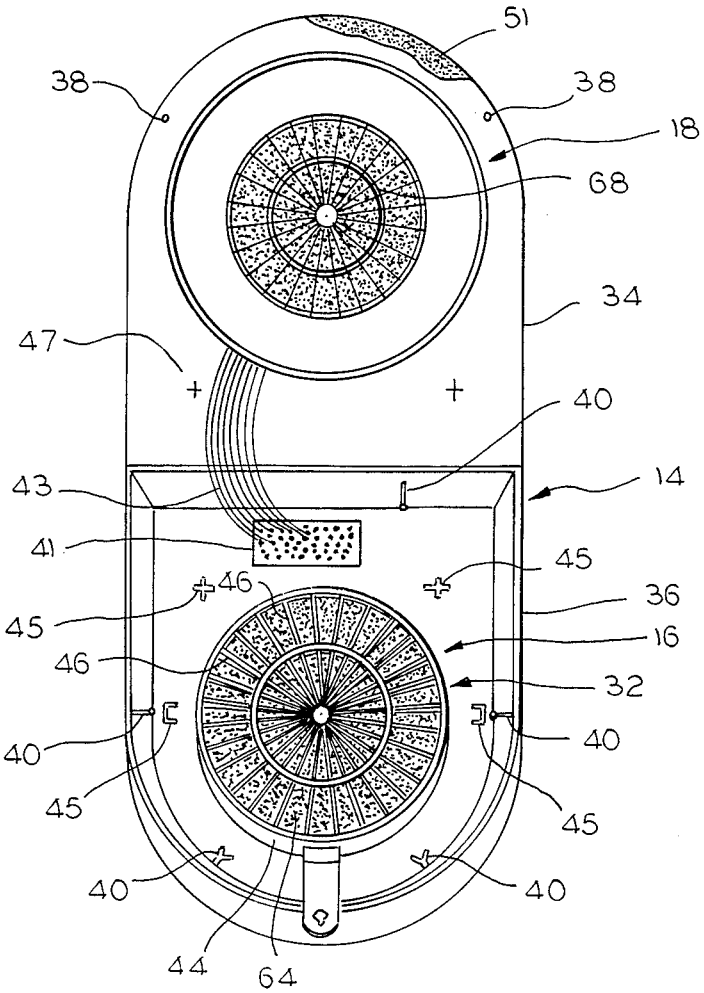
FIG. 2 is a perspective view of the dartboard and housing element of FIG. 1, illustrating the interior of same.
Figure 3:
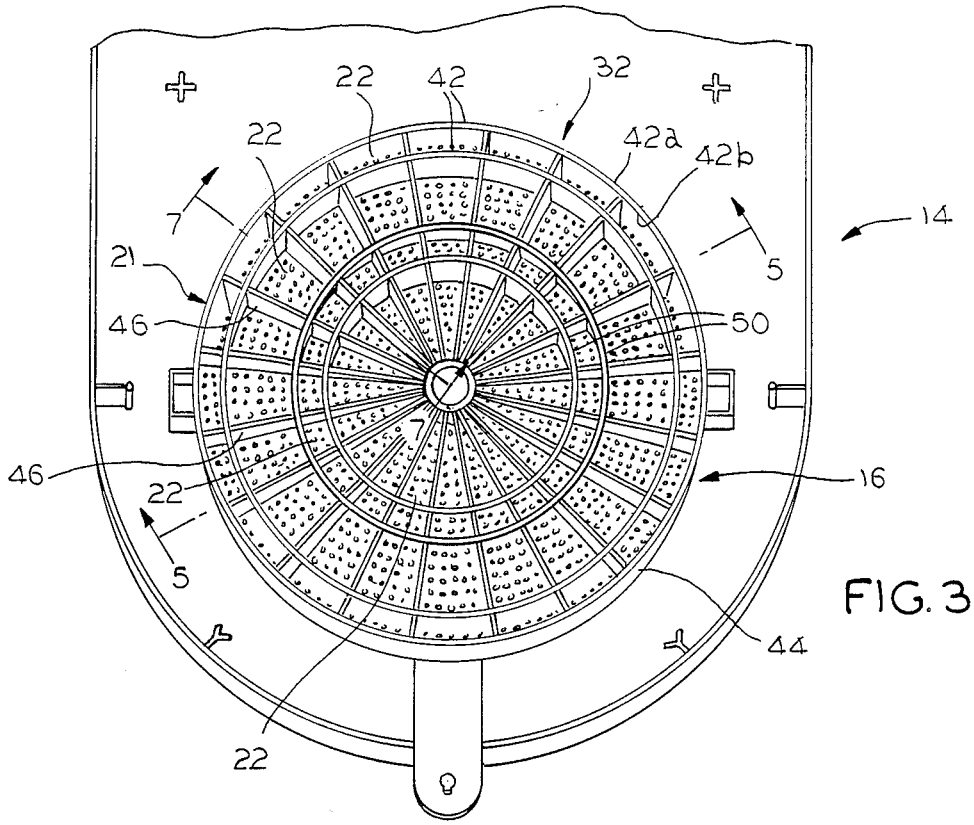
FIG. 3 is a fragmentary perspective view of the dartboard and housing element of FIG. 2, showing an array of target plates in the spider.

FIGS. 2 and 3 illustrate the interior of housing element 14. Generally, housing element 14 includes a main housing section 36 which is integrally attached to spider 32. A backplate 34 is attached to housing element 14 with screws 38 that fit into screw holes 40, both of which are along the perimeter of housing section 36 and backplate 34. Projections forming mounting posts 45 also provide an additional mechanism for fastening housing 36 and backplate 34 together Specifically, mounting posts 45 of housing 36 attach to mounting openings 47 of backplate 34.

Housing section 36 includes a spider 32 which is integrally molded therewith and which forms the frame that holds the plates 22. Housing section 36 and spider 32 are manufactured from a single piece of material section 36 further houses a microprocessor board 41 that is connected to an area of backplate 34 by wires 43. The microprocessor board 41 includes a display area on the side of the board 41 that is facing section 36. The display area of microprocessor board 41 is visualized through a display panel 49 (see FIG. 1) which is located on the exterior portion of section 36 or that portion of section 36 that is visible when backplate 34 is fastened to section 36. Spider 32 is generally circular in shape and comprises an outer section or wall 42 comprising two parallel spaced apart wall sections 42*a* and 42*b*. The outer edge of wall 42 includes a flange 44 which abuts the housing element 14 and is molded integrally therewith. Spider 32 further includes a series of axially and radially extending ribs 46 which are integral with and perpendicular to their rows of connection to outer wall 42. Ribs 46 extend inwardly from outer wall 42 towards the center 48 of the dartboard. Paralleling outer wall 42 is an inner wall 50 which is positioned approximately half-way between outer wall 42 and center 48. Inner wall 50 has the same circular curvature as outer wall 42 but is smaller in diameter. The outer wall 42, inner wall 50, flange 44 and ribs 46 of spider 32 are molded from a single piece of material. The spider has a depth of at least ½ inch in the preferred embodiment so that it can accommodate the movable plates 22.

As shown in FIGS. 1–3, movable plates or target segments 22 of spider 32 extend circumferentially and radially within spaced cavities and more specifically, into sub-cavities 24, 26, 28 and 30 around the entire circumference of dartboard 16. Sub-cavity 24 is the outermost cavity and is situated between the two spaced walls 42*a* and 42*b* comprising outer wall 42 of spider 32. Sub-cavity 26 is positioned between the inner portion 42*b* of outer wall 42 and the outer portion of inner wall 50. Sub-cavity 28 is situated between the two spaced apart walls comprising inner wall 50. Sub-cavity 30 is located between the inner portion of inner wall 50 and center 48. Accordingly, movable plates 22 are shaped and adapted to fit into the different sub-cavities 24, 26, 28 and 30.

Figure 4:
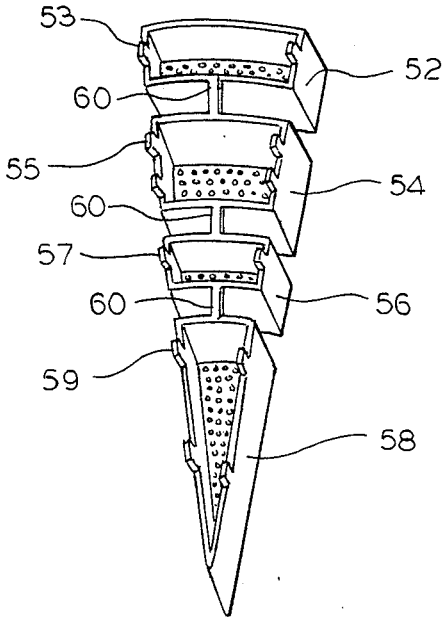
FIG. 4 is an exploded perspective view of one of the target plates of FIG. 3.

FIG. 4 shows the interconnected movable plates 22 as they would appear individually and in a separated state. The movable plates 22 generally have four different shaped segments to accommodate the different areas of spider 32. The plates 22 shown in FIG. 4 form a pie-shape, in which: outer segment 52 is adapted to fit inside of the two sides 42*a* and 42*b* of outer wall 42; segment 54 fits between outer wall 42 and inner wall 50; segment 56 fits between the two sides of inner wall 50; and segment 58 fits between inner wall 50 and center 48. Segments 52, 54, 56 and 58 of the pie-shaped plates 22 are connected together by living hinges 60 and are formed in a single molding process. Segments 52, 54, 56 and 58 are molded in connected pieces and are placed into spider 32 as a single unit. Living hinges 60 provide segments 52, 54, 56 and 58 with sufficient flexibility such that each segment may move independently in relation to the other pieces in an axial direction. The center of movable plates 22, as shown in FIG. 3, is independently connected to the spider.

Movable plates 22 include a plurality of holes 64 (FIGS. 1, 2, 3) which serve to receive and retain a thrown dart. Holes 64 are formed in each segment 52, 54, 56 and 58 of movable plates 22 during the molding process and extend completely through each piece. Each of the holes 64 is approximately the size of the tip of the thrown dart. Movable plates 22 further include a plurality of projections that extend outwardly from plates 22 and contact a rubber plate or piece 51 which serves to protect a mylar switch 68 which is attached to the back plate 34. The projections are symmetrically positioned and include two projections 53 on segment 52, four projections 55 on segment 54, two projections 57 on segment 56 and four projections 59 on segment 58. Thus, when any of segments 52, 54, 56 or 58 are caused to move inwardly, one of the projections (53, 55, 57 or 59) contacts rubber sheet 51 which in turn contacts mylar switch 68.

Back plate 34 primarily houses and retains mylar switch 68. Back plate 34 is shaped in the same configuration as house element 14. Back plate 34 includes a contoured part 18 which extends around mylar switch 68. Contoured part 18 is inwardly contoured such that it projects towards housing element 14.

Figure 9:
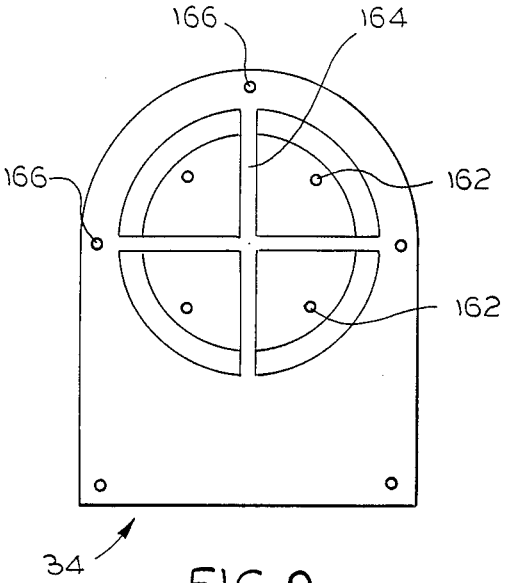
FIG. 9 shows a front plan view of the inventive back plate that is illustrated in FIG. 2.
Figure 10:
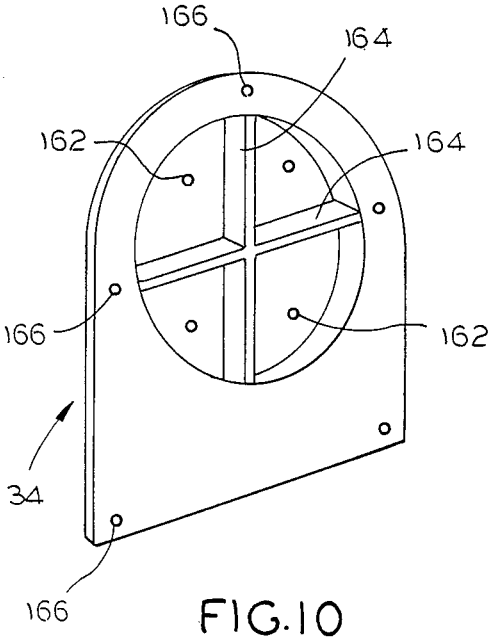
FIG. 10 shows a back perspective view of the inventive back plate of FIG. 9.

FIGS. 9 and 10 show the front view and rear view of back plate 34, respectively. Back plate 34 includes a plurality of studs 162 which project through back plate 34 and into mylar switch 68 whereby they serve to secure switch 68 to plate 34. Back plate 34 further includes horizontal and vertical supports 164 which serve to reinforce back plate 34. The inwardly extending contoured part 18 may be seen in FIG. 10. Also, mounting screws 166 are located on back plate 34 and are used to attach back plate 34 to housing assembly 14.

Figure 11:
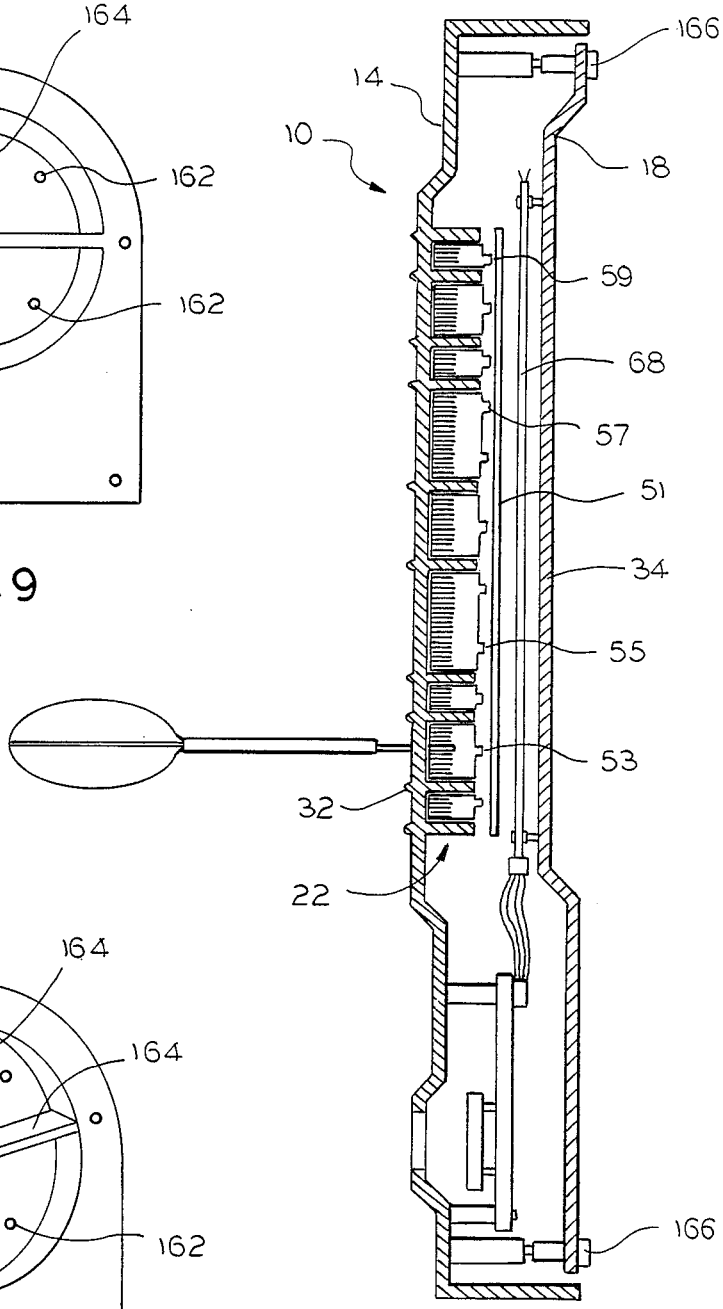
FIG. 11 shows a cross-sectional view of the inventive dart board, housing element and back plate, taken along lines 11—11 of FIG. 1.

FIG. 11 shows the manner in which housing assembly 14 is attached to back plate 34 by mounting screws 166. Between housing assembly 14 and back plate 34 are: spider 32 which holds pie segments 22; projections 53, 55, 57 and 59, rubber sheet 51 and mylar switch 68. The operation of the dartboard assembly and the relationship of the component parts shown in FIG. 11 may be better understood in the description which follows.

Figure 5:
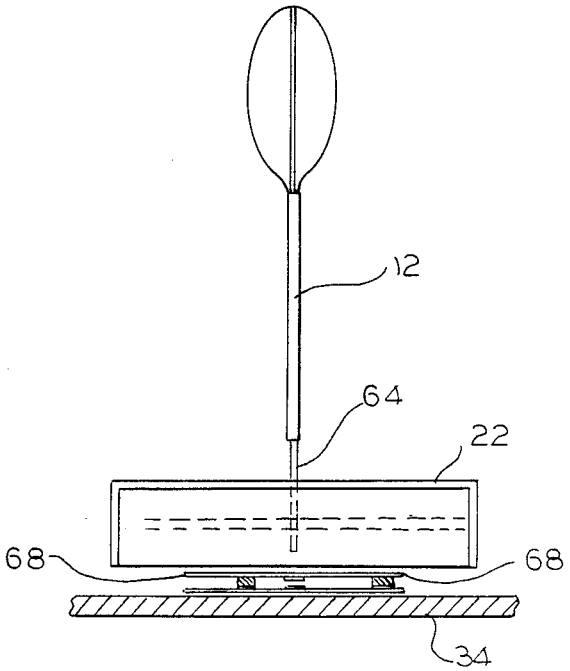
FIG. 5 is a fragmentary cross-section taken substantially above the line 5—5 of FIG. 3.

FIG. 5 shows a thrown dart 12 as it appears after it strikes plates 22. The force of the dart striking plate 22 in hole 64 causes plate 22 to be pushed inwardly in an axial direction and bear upon at least one switch means 68. Switch means 68 is operatively connected to electronic scoring circuit 18 by appropriate electrical connecting means 100 (FIG. 6) such as wires, flexible circuit board material, or the like. When dart 12 strikes plate 22, the force transmitted by plate 22 actuates switch means 68, causing a temporary change in the electrical state of the switch which can be sensed by electronic scoring circuit 18.

Switch means 68 is shown in FIG. 5 as a mylar switch system, but any suitable position or pressure sensing device producing an electrical response might be used. At least one switch means 68 is provided for each of the movable plates 22 representing unique scoring areas on the inventive dart board. This permits the electronic scoring circuit 18 to determine which movable target plate was hit by the dart so it may apply an appropriate credit to the players score. Switch means 68 are preferably mounted on back plate 34.

Figure 6A:
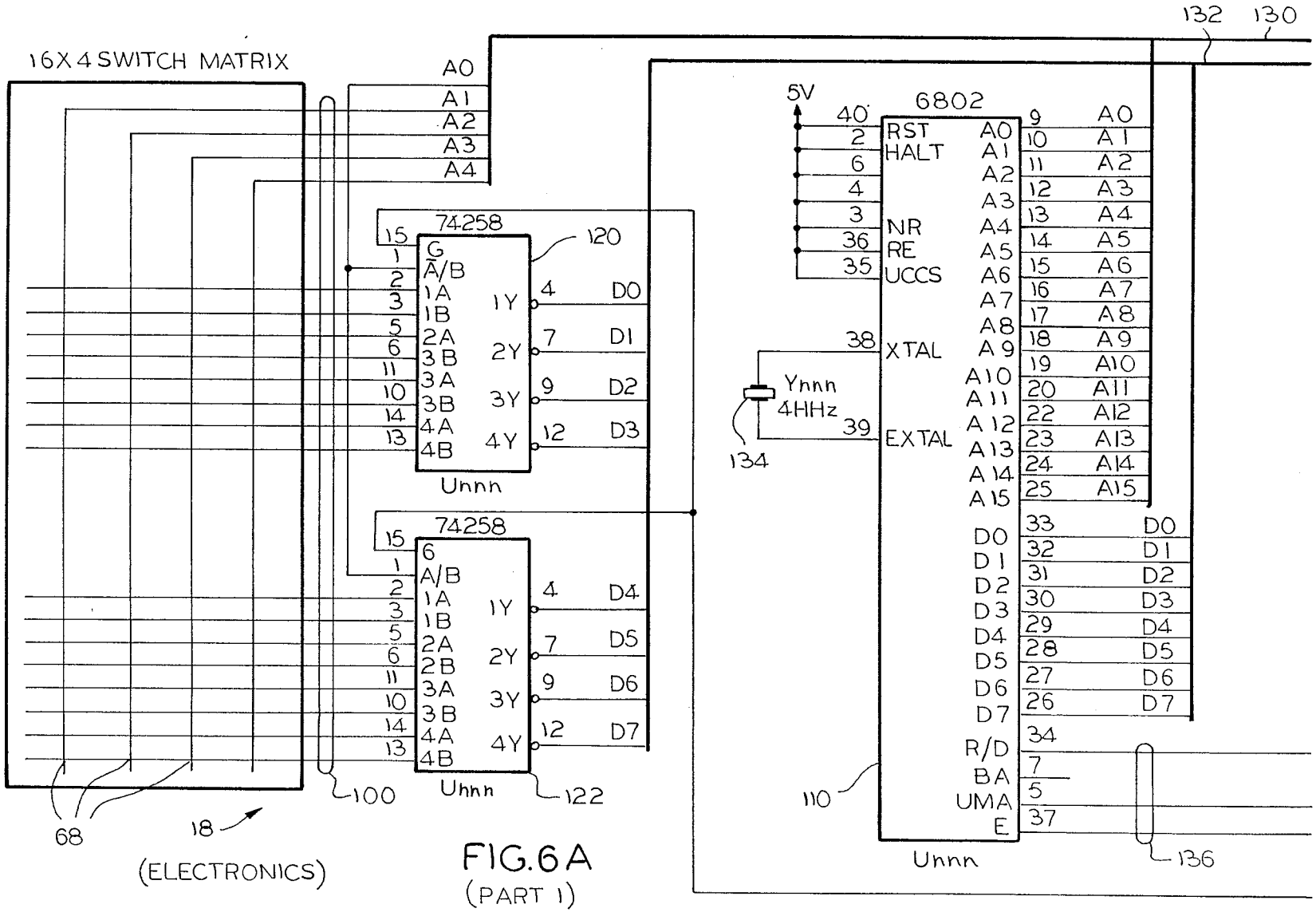
FIG. 6A (Part 1 and Part 2) shows an electrical schematic diagram for a suitable electronic scoring and display circuit for use with the dart board of FIGS. 1–5.
Figure 6A:
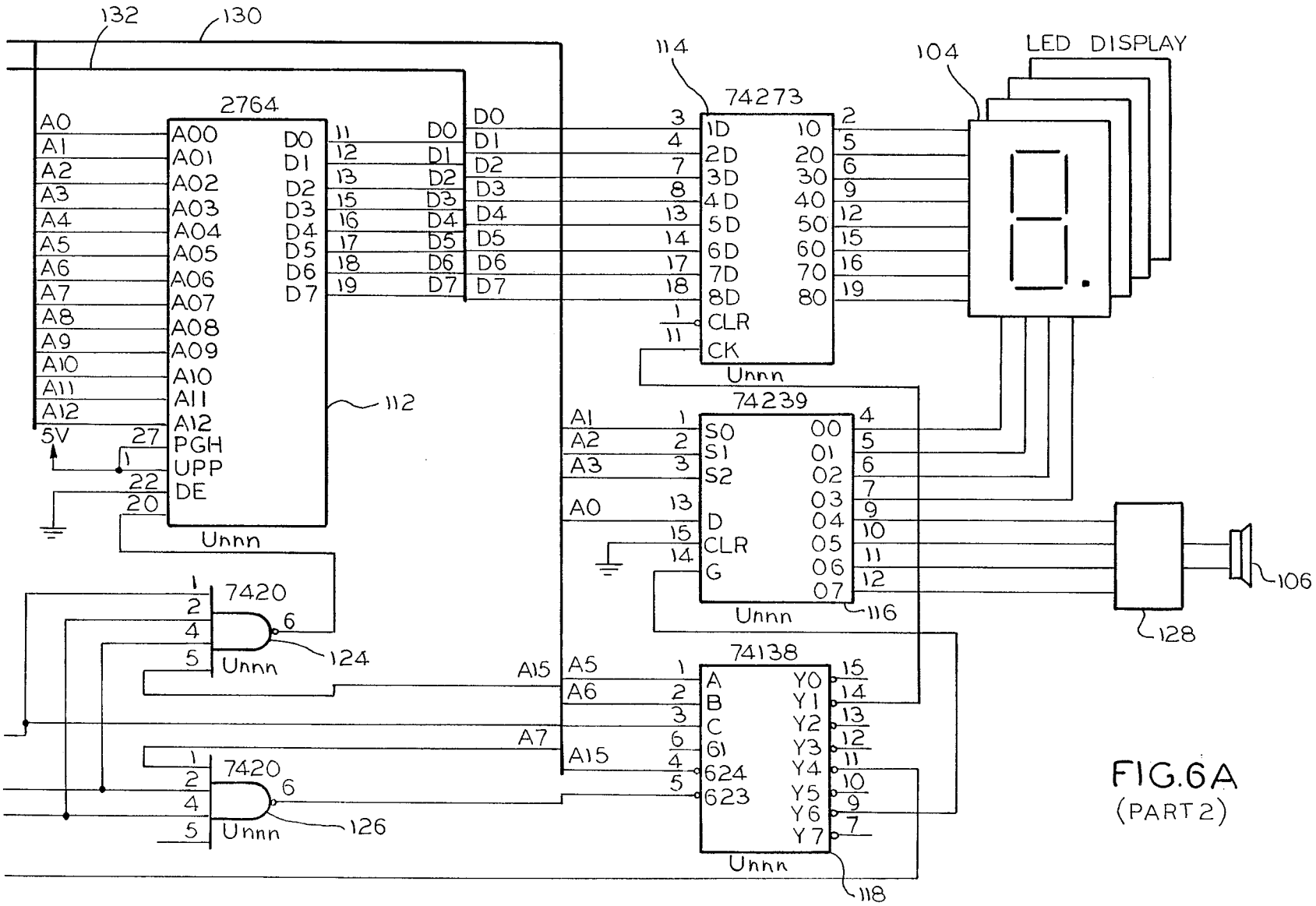

FIG. 6A (Part 1 and Part 2) shows an electrical schematic diagram for a suitable electronic scoring and display circuit for use with the inventive dart board 10. Switches 68 are shown connected to the circuit 18 via suitable electrical interconnection means 100. The scoring circuit also includes a numeric display 104 and a speaker 106. The purpose of the scoring circuit is to detect when a dart 12 strikes a plate 22, and to apply a predefined scoring action associated with the struck plate to the score shown on display 104. For example, for a particular plate 22, displayed score might be increased by 10. Scoring circuit 18 may also emit appropriate sounds from speaker 106.

The switches 68 are shown electrically as a 16 by 4 matrix of switch crosspoints, and circuit 18 is adapted to "scan" the matrix to determine which of the switches 68 are active at a particular time. While each one of switches 68 could be individually wired to the scoring circuit 18, this would require one hundred twenty eight interconnection means; the matrix organization shown herein advantageously reduces the number required to 20. While the switches are electrically organized into a matrix, this electrical organization has no effect on the mechanical arrangement of switches.

The 16 by 4 matrix of switches 68 of FIG. 6A permits scoring circuit 18 to distinguish between sixty-four different scoring actions, each of which may be associated with at least one of the moving plates 22. If it is desired that a plurality of plates 22 be associated with a single scoring action, the switches 68 for those plates 22 may be wired in parallel. Thus, under some circumstances, a particular crosspoint shown in the drawing may actually represent several physical switches, and the circuit shown could service more than sixty-four plates 22. In addition, the circuit could be easily extended to an arbitrarily large number of switches and scoring regions if desired. The use of scanned switch matrices is well known in the electronic arts and therefore a detailed description is not provided herein.

Scoring circuit 18 is preferably implemented as a microprocessor control circuit comprising a microcomputer 110, oscillator crystal 134, read only memory (ROM) 112, latches 114, 116, address decoding logic devices 118, 124, and 126, multiplexers 120, 122, and speaker driver device 128. This circuit will be described only briefly, since similar circuits are well known in the art.

Microcomputer 110 (MCU) is preferably a type MC6802 microcomputer integrated circuit (IC), available from Motorola Semiconductor, Inc. of Phoenix, AZ. The program to control the MCU 110 is stored in ROM 112, which may be a type 2764 device available from Intel Corporation of Sunnyvale, CA. This device contains 8K bytes of read only memory which is sufficient to store the program contemplated herein. The MCU 110 includes one hundred ninety-two bytes of random access memory which is sufficient to execute the scoring program contemplated herein. Multiplexers 120, 122 interface MCU 110 to switches 68 and permit MCU 110 to selectably determine the status of particular subset of switches 68. Latches 114 and 116 interface the display 104 and speaker driver device 128 to MCU 110, permitting MCU 110 to control the information on the display 104 and the sound emitted from the speaker 106. Crystal 134 controls the frequency of an internal oscillator in the MCU 110.

The MCU 100 communicates with multiplexers 120, 122, ROM 112, latches 114, 116, and address decoding devices 118, 124, 126 over three electrical interconnection busses known as the address bus 130, the data bus 132, and the control bus 136. The address decoding circuitry 118, 124, 126 permits the MCU 110 to select one of these devices for communication at a particular time.

In operation, when scoring circuit 18 determines that a particular switch 68 has been actuated by a dart 12 striking a plate 22, the circuit 18 applies a predefined scoring action to the score shown on display 104. The particular scoring action associated with each plate 22 is controlled by and dependent on the program stored in ROM 112. In addition, the MCU 110 may cause a sound to be emitted from speaker 106 when a dart strikes certain predefined plates 22 or when a predefined score is reached (e.g. a winning score).

Figure 6B:
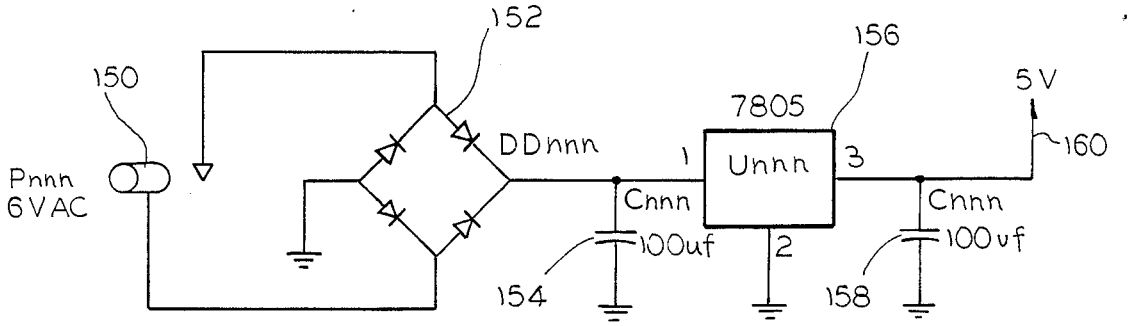
FIG. 6B shows an electrical schematic diagram for a power supply for use with the circuit of FIG. 6A.

FIG. 6B shows a suitable power supply circuit for the scoring circuit 18 of FIG. 6A. The power supply circuit includes power transformer 150, bridge rectifier 152, first filter capacitor 154, voltage regulator 156, and second filter capacitor 160. The transformer preferably receives electrical power from a standard wall outlet (e.g. the 120 V AC outlet typically found in homes and offices in the U.S.) and provides power at 6 V AC which is closer to the 5 V DC required by scoring circuit 18. Voltage regulator 156 is preferably a type 7805 three-terminal IC voltage regulator which provides 5 V at 1 Amp. Power supplies of this type are extremely well known in the art; therefore further description will be omitted.

The materials from which dartboard assembly 10 is constructed include a rigid plastic material for the housing element 14, spider 32 and movable plates 22 and back plate 34. The housing assembly 14 with spider 32, the movable plates 22 and back plate 34 are formed by well-known injection molding techniques and are each integrally molded into a single piece. The sheet 51 which protects the mylar switch 68 may be made from any flexible material, including rubber, nylon or thin plastic.

Dartboard assembly 10 has not been described in terms of approximate measurements, as it should be understood that the size of the dartboard may vary in accordance with the manufacturing equipment's capabilities.

Therefore, it should be recognized that, while the invention has been described in relation to preferred embodiments thereof, those skilled in the art may develop a wide variation of structural details without departing from the principles of the invention. Therefore, the appended claims are to be construed to cover all equivalents falling within the true scope and spirit of the invention.

The invention claimed is:

1. A dart game assembly comprising a housing element, a spider, a plurality of target plates and a back plate, said spider being generally circular in shape and comprising a series of circumferentially and radially extending ribs integrally molded with said housing element from a single piece of material, said circumferentially and radially extending ribs forming interiorly spaced cavities that are adapted to receive said plurality of target plates, each of said plurality of target plates comprising several target segments which are interconnected and capable of independent movement upon being impacted by a dart, said back plate being integrally molded from a single piece of material and being attached to said housing element.

2. The dart game assembly of claim 1 wherein said series of radially extending ribs of said spider extend inwardly from an outer wall of said spider towards a center of said dart game assembly, said assembly further including a plurality of circularly extending walls that are positioned between each of said radially extending walls, and which divide said interiorly spaced cavities into a plurality of sub-cavities.

3. The dart game assembly of claim 1 wherein said plurality of target segments are interconnected to one another by hinge means.

4. The dart game assembly of claim 3 wherein said hinge means comprise living hinges interconnecting each of said target segments, and said target segments are molded from a single piece of material.

5. The dart game assembly of claim 2 wherein said plurality of target plates are shaped and adapted to fit into said cavities of said spider, each of said target plates being placed into respective cavities of said spider as a single unit.

6. The dart game assembly of claim 1 wherein said housing element includes mounting post means integrally molded therewith, said mounting post means adapted to secure an electronic component board to said housing element.

7. The dart game assembly of claim 1 wherein said target plates include means to capture said darts.

8. The dart game assembly of claim 1 wherein said back plate is attached to said housing element, said plurality of target plates comprising said target segments which are adapted to individually contact a switch means mounted on said back plate upon contact with a dart, whereby said target plates are molded from a single piece and have segments interconnected by a living hinge, whereby only the target segment which is impacted by the dart will move axially and contact said switch means adjacent that particular target segment.

9. The dart game assembly of claim 8 wherein said back plate includes an inwardly contoured portion on which said switch means is mounted, said back plate further including at least one support which extends across said inwardly contoured portion and which provides reinforcement for said back plate.

* * * * *